US005873516A

United States Patent [19]

Boggs

[11] Patent Number: 5,873,516

[45] Date of Patent: Feb. 23, 1999

[54] CARTON WITH RECLOSEABLE LID HANDLE COMBINATION

[75] Inventor: David S. Boggs, Cincinnati, Ohio

[73] Assignee: Rock-Tenn Company, Norcross, Ga.

[21] Appl. No.: 903,622

[22] Filed: Jul. 31, 1997

[51] Int. Cl.[6] ..... B65D 25/04

[52] U.S. Cl. ..... 229/120.32; 229/117.13

[58] Field of Search ..... 229/120.32, 117.09, 229/117.13; 220/415, 522, 521

[56] References Cited

U.S. PATENT DOCUMENTS

| | | | |
|---|---|---|---|
| 2,614,746 | 10/1952 | Frankenstein | 229/120.09 |
| 2,670,125 | 2/1954 | Frankenstein | 229/415 X |
| 2,939,625 | 6/1960 | Snyder . | |
| 3,384,224 | 5/1968 | Buckholz et al. | 229/120.32 X |
| 3,443,736 | 5/1969 | Steinbock | 229/117.13 X |
| 3,591,071 | 7/1971 | Rosenburg . | |
| 3,642,125 | 2/1972 | Johnson | 229/120.32 X |
| 4,088,262 | 5/1978 | Kuehlhorn | 229/120.32 X |
| 4,335,844 | 6/1982 | Egli . | |
| 4,438,848 | 3/1984 | Montealegre et al. | 206/588 |
| 4,712,689 | 12/1987 | Froom . | |
| 4,768,703 | 9/1988 | Sosler et al. . | |
| 4,986,420 | 1/1991 | Gunn et al. . | |
| 5,131,207 | 7/1992 | Wischusen, III et al. . | |
| 5,240,176 | 8/1993 | Akers | 229/155 |
| 5,518,172 | 5/1996 | Nanno . | |
| 5,566,878 | 10/1996 | Peiffer et al. . | |

FOREIGN PATENT DOCUMENTS

| | | | |
|---|---|---|---|
| 4-44947 | 2/1992 | Japan | 229/120.32 |

*Primary Examiner*—Allan N. Shoap
*Assistant Examiner*—Tri M. Mai
*Attorney, Agent, or Firm*—Jones & Askew, LLP

[57] ABSTRACT

A carton with a handle and recloseable lid. The carton is formed of foldable material and can be efficiently reclosed after opening to prevent spillage or leakage of the product contained by the carton. The recloseable lid includes upper and lower panels which are in spaced-apart relation to each other. When the lid is closed, the upper panel forms a top for the carton and the lower panel forms a partition inside the carton. The lower compartment forms the containment area for product placed into the container. The upper compartment forms a space for the fingers and hand of a user inserted through a handle opening defined in the upper panel of the lid for carrying the carton. The upper panel includes a pair of flaps each one of which is connected to the ends of the upper panel adjacent to the hingedly connected side of the upper panel. The flaps fold downward and insert into the carton when the lid is closed. When the lid is open, the flaps stay tucked inside the upper edges of side panels of the carton, or alternatively, engage upper edges of side panels of the carton and hold the lid in an open configuration. A top panel is connected to the side opposite the side to which the lid is connected. The top panel overlays a portion of the upper panel of the lid and includes a flap for engaging the lid handle to lock the lid in a closed configuration.

23 Claims, 9 Drawing Sheets

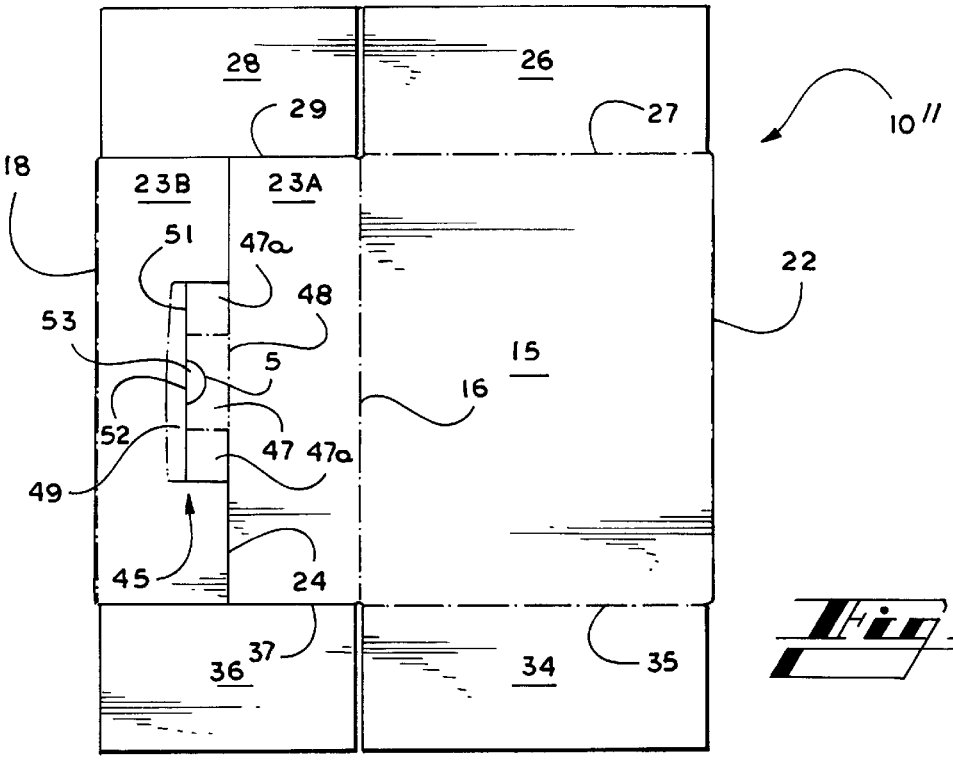
Fig. 5
Fig. 6
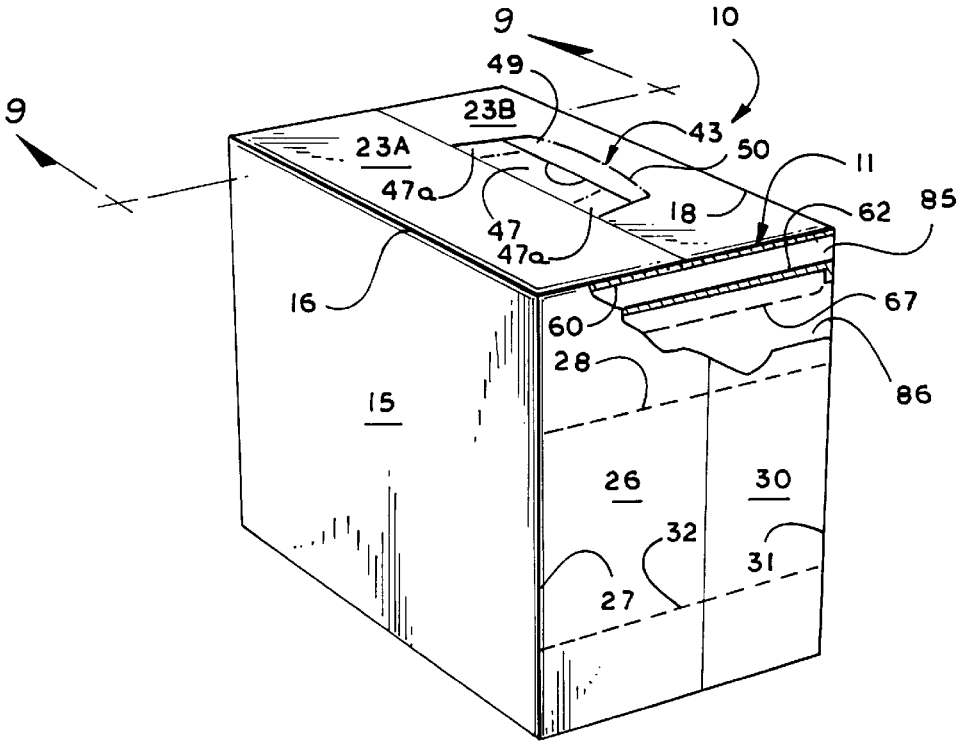

CARTON WITH RECLOSEABLE LID HANDLE COMBINATION

FIELD OF THE INVENTION

The present invention relates to cartons and boxes, and more particularly relates to a corrugated carton with a recloseable lid/handle structure which closes and partitions the carton.

BACKGROUND OF THE INVENTION

In recent years, a variety of consumer boxes and cartons have been developed for packaging, shipping, storing, carrying, and dispensing a variety of products. An example of such packages and cartons is a carton for carrying fluent solid materials such as washing detergents, animals feeds and the like. A typical container for such products may often include a paperboard box with an openable lid or tear away dispenser and some type of attached or formed handle for carrying the carton or box.

A cardboard carton for granules including a lid having a locking recess for securing the lid is disclosed in U.S. Pat. No. 5,518,172. The contents of the carton are covered by a disposable sealing paper. The carton's handle is mounted to the side panels of the carton.

A carton for holding a detergent or other fluent solid material is disclosed in U.S. Pat. No. 5,566,878. The carton is made of paperboard and includes a handle on the side to facilitate pouring the contents. The handle configuration includes a false compartment that allows for deployment and use of the handle.

U.S. Pat. No. 4,768,703 discloses a carton with a hinged top panel for pouring the contents of the carton. The carton includes a membrane liner underneath the top panel for resealing the carton.

U.S. Pat. No. 4,986,420 discloses a package having a handle for housing granular or similar products. The handle is a substantially flat strap handle which has a barb member on each end. The handle is inserted into two opposing openings in the side walls of the package.

In those systems, a carton or container is reclosed by covering the open portion of the container with a liner, hinged lid or hinged flap. In those systems, the carton closures often do not close the carton sufficiently to prevent leakage or spillage of the contents of the carton. Additionally, most of those systems are carried by use of an externally mounted or formed handle which operates independent of the opening from which the contents of the carton or package are dispensed. Such handles typically protrude from or hang from the exterior surfaces of the container and may easily snag or catch on other boxes during shipment or storage. The handles may also interfere with top loading and top closure of the containers, and consequently, often require additional manufacturing steps in loading the containers. Also, the use of handles added to the container and produced from a different material or different piece of material increases the material and manufacturing costs of such containers.

There is a need in the art for a carton, formed from a foldable blank, that may be quickly and efficiently reclosed after opening and that prevents spillage or leakage of the contents of the carton. There is a further need in the art for a carton which may be end-loaded independent of the top closure/lid of the carton. There is a further need in the art for a carton having a carrying handle which is flush with the exterior surfaces of the carton to facilitate ease of stacking and shipment of the carton. There is further need in the art for a carton having a carrying handle and recloseable lid structure that minimizes contact of the user with the contents of the carton when carrying the carton.

SUMMARY OF THE INVENTION

The present invention seeks to provide a carton of foldable material that can be efficiently and quickly reclosed after opening to prevent spillage or leakage of the product contained by the carton. The present invention seeks to provide a carton that may be end-loaded independent of the top closure/lid of the carton, leaving the top closure/lid of the carton free for incorporation of a handle formed from material of the blank from which the carton is formed. The present invention further seeks to provide a carton having a handle that is flush with the exterior surfaces of the carton. The present invention further seeks to provide a carton with a recloseable lid/carrying handle structure that allows the user to reclose the previously opened carton utilizing the handle of the carton while keeping the users hands and fingers segregated from the contents of the carton.

In accordance with the invention, these objects are accomplished in a carton assembled from foldable material and defining a hingedly connected lid that is openable and closeable relative to the carton. The lid includes upper and lower panels which are in spaced-apart relation to each other. When the lid is closed, the upper panel forms a top for the carton and the lower panel forms a partition inside the carton. The partition divides the carton into two compartments. The lower compartment forms the containment area for product placed into the container. The upper compartment forms a space for the fingers and hand of a user inserted through an optional handle opening defined in the upper panel of the lid for carrying the carton. The upper panel may include a pair of flaps each one of which is connected to the ends of the upper panel adjacent to the hingedly connected side of the upper panel. The flaps fold downward and insert into the carton when the lid is closed. When the lid is open, the flaps engage upper edges of side panels of the carton and hold the lid in an open configuration.

According to one of its aspects, the present invention provides a carton, comprising a plurality of side panels; a bottom panel; and a lid hingedly connected to an upper edge of one of the plurality of side panels along one side of the lid. The lid comprises an upper panel; a lower panel in spaced-apart relation to the upper panel; and a lid side panel. The lid side panel extends between the upper and lower panels along respective side edges thereof opposite the upper edge of the side panel to which said lid is connected. The lower panel forms a partition interior of the carton.

In a preferred embodiment, the partition is substantially parallel to the top surface and divides the carton into two compartments. Preferably, the lid side panel is substantially perpendicular to the lower panel when the lid is in a closed configuration; and the lid side panel is at an obtuse angle relative to the lower panel when the lid is in an open configuration.

The upper panel has first and second ends, and the lid may comprise a pair of flaps foldably attached to the upper panel with one of the pair of flaps attached at each of the first and second ends of the upper panel. When the lid is closed, the flaps are folded downwardly substantially perpendicular to the upper panel and into the carton. Each of the flaps of the pair of flaps engages upper edges of one of the plurality of side panels to hold the lid in an open configuration.

The carton may comprise a handle formed in the upper panel of the lid for carrying the carton. The handle is coplanar with an upper surface of the upper panel. The handle is defined by an opening in the upper panel.

If desired, the carton may further comprise a first top panel hingedly connected to an upper edge of one of the plurality of side panels opposite the one of the plurality of side panels to which the lid is connected. The first top panel overlays a portion of the upper panel of the lid when the lid is in a closed configuration. The first top panel comprises a handle flap hingedly connected to a peripheral edge of the first top panel. When the handle flap is folded downward, the handle flap folds into the opening defined by the handle and between the upper and lower panels of the lid to lock the lid in a closed configuration.

A second top panel may be hingedly connected to the upper edge of one of the plurality of side panels to which the lid is connected. The second top panel overlays a portion of the upper panel of the lid; and the second top panel is fixedly attached to the upper panel of the lid. A peripheral edge of the second top panel opposite the upper edge of the one of the plurality of side panels lies adjacent the peripheral edge of the first top panel when the first top panel overlays a portion or the upper panel of the lid.

The carton may be formed from a single blank of material. Alternatively, the plurality of side panels and the bottom panel may be formed from a first blank of material; and the lid may be formed from a second blank of material. The carton may be formed from corrugated paperboard.

According to another of its aspects, the present invention provides an improved lid for a carton, comprising an upper panel; a lower panel in spaced-apart relation to the upper panel; and a lid side panel. When the lid is mated to the carton, the lid is inserted into the carton until the upper panel forms a top of the carton and the lower panel forms a partition interior of the carton.

The lid is hingedly connected to an upper edge of a side panel of the carton along one side of the lid. The lid is hingedly openable and closeable relative to the carton. The lid side panel is substantially perpendicular to the lower panel when the lid is in a closed configuration, and the lid side panel is at an obtuse angle relative to the lower panel when the lid is in an open configuration. The lid further comprises a handle in the upper panel of the lid for carrying the carton. The handle is coplanar with an upper surface of the upper panel.

The carton may comprise a top panel hingedly connected to an upper edge of a second side panel of the carton opposite the side panel to which the lid is connected. The top panel overlays a portion of the upper panel of the lid when the lid is in a closed configuration relative the carton.

The top panel of this aspect may comprise a handle flap hingedly connected to a peripheral edge of the top panel. When the handle flap is folded downward, the handle flap engages the handle to lock the lid in a closed configuration.

Other objects, features, and advantages of the present invention will be apparent upon reviewing the following detailed description of the preferred and alternate embodiments, when taken in conjunction with the drawings and appended claims.

BRIEF DESCRIPTION OF DRAWINGS

FIG. 5 is a plan view of the blank of FIG. 4 folded and glued to form an assembled, but unerected carton in a flat form for shipping.

FIG. 6 is a pictorial view of the fully erected and closed carton with portions of the walls broken away to show interior detail and showing a recloseable lid side flap in phantom.

DETAILED DESCRIPTION OF PREFERRED EMBODIMENT

Figure 1:
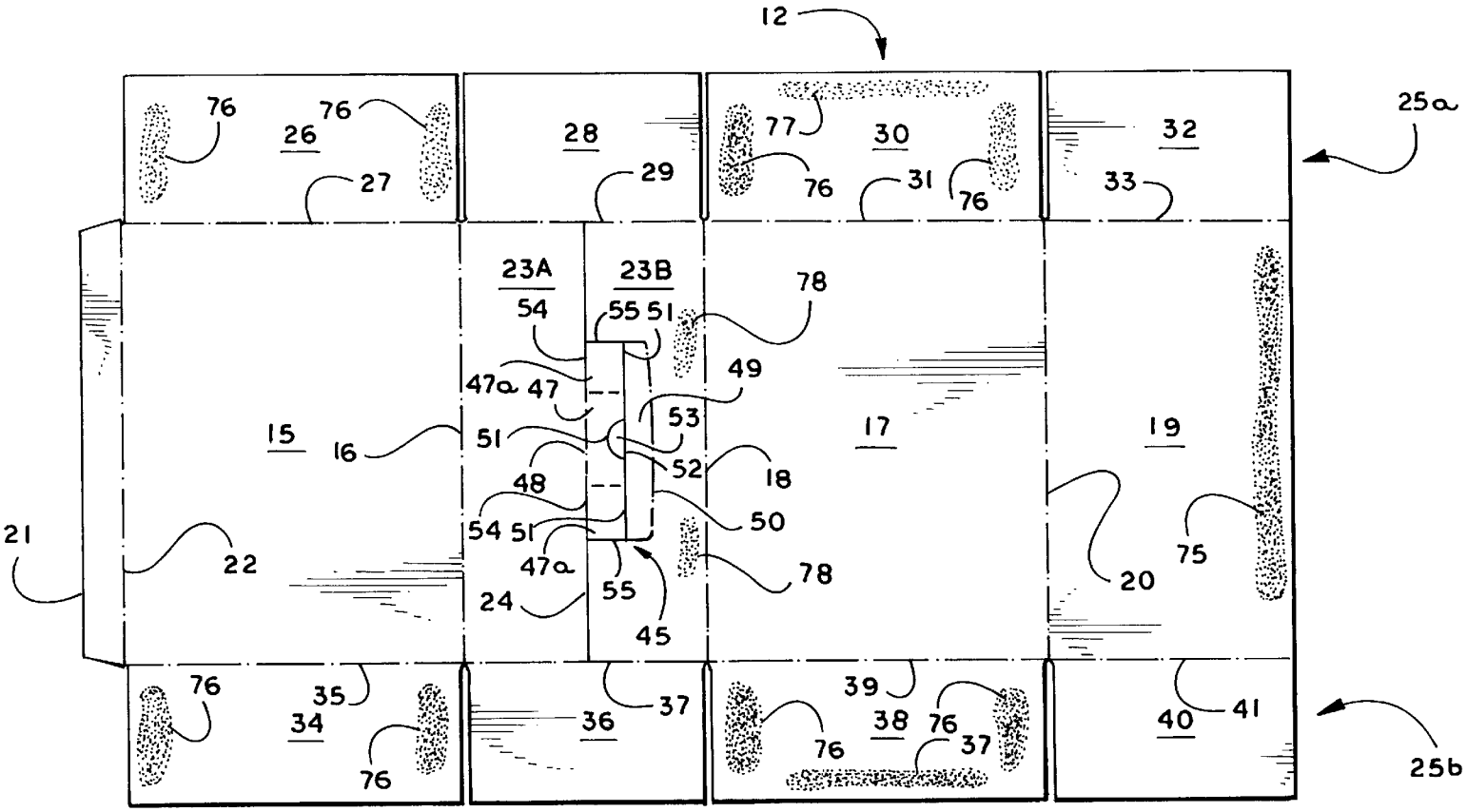
FIG. 1 is a plan view of the interior surface of a blank from which a carton embodying the present invention can be assembled.

Referring now in more detail to the drawings, in which like numerals refer to like parts throughout the several views, FIG. 6 shows a fully erected and closed carton 10 of the present invention with a handle defined in a recloseable lid 11. The carton 10 is constructed of a blank 10' of foldable sheet material, shown in FIG. 4. The recloseable lid 11 includes an upper panel 60 and a lower panel 62. The upper panel 60 includes an opening 72 defining a handle for insertion of the fingers of the user for carrying carton 10. The lower panel 62 is in substantially parallel spaced-apart relation to the upper panel 60 and provides a partition between the contents of the carton and the user's fingers when the user carries the carton 10. Thus, the recloseable lid 11 provides a handle 43 for carrying the carton 10 and provides for closure of the carton to prevent spillage of the contents and to prevent contact between the contents of the carton and the user's fingers.

The structural features which accomplish these objects of the invention are formed from a blank 10' of foldable material, preferably conventional corrugated paperboard box material. However, a carton according to the present invention can be formed from any foldable and scorable material, such as solid paperboard or plastic sheeting.

Figure 2:
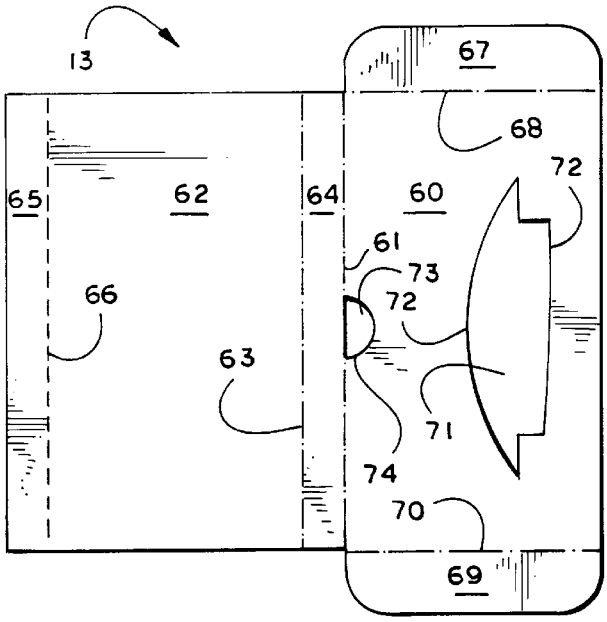
FIG. 2 is a plan view of the interior surface of a blank from which a carton top closure embodying the present invention can be assembled.
Figure 3:
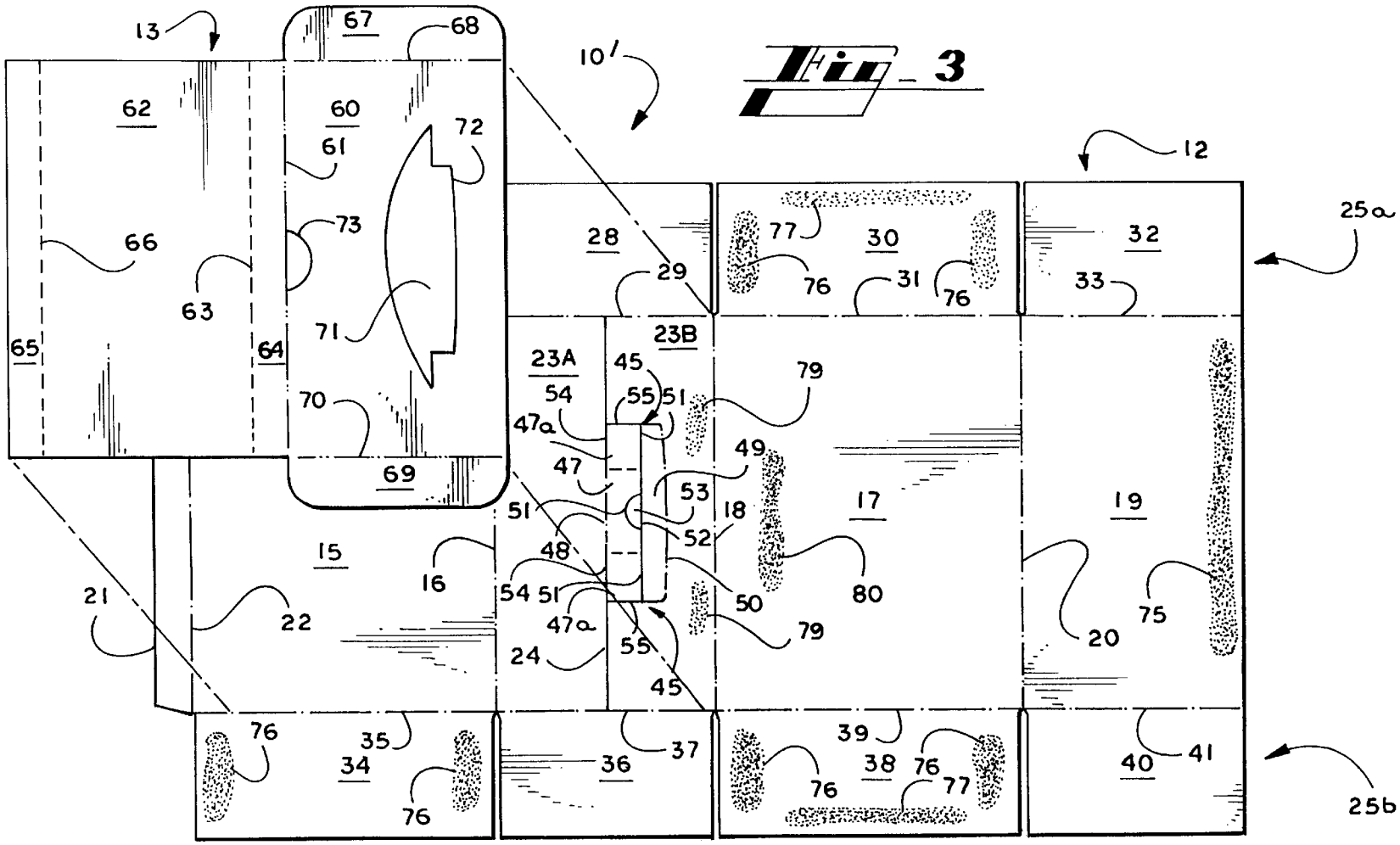
FIG. 3 is an exploded plan view of a blank formed by combining the blank of FIG. 1 with the blank of FIG. 2 and showing via dotted lines the placement of the blank of FIG. 2 onto the blank of FIG. 1 during assembly of the blank.
Figure 4:
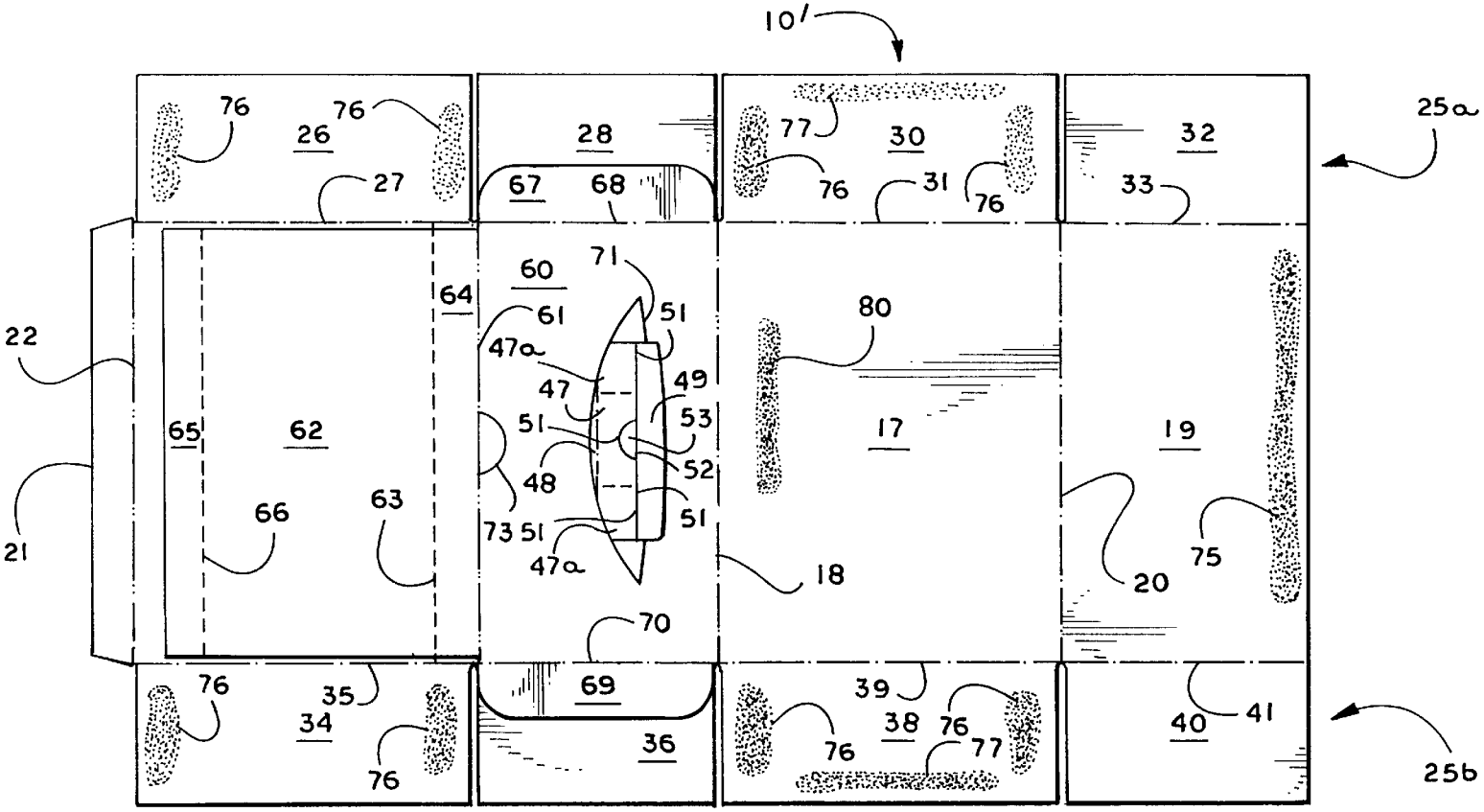
FIG. 4 is a plan view of a the assembled blank of FIG. 3.

The blank 10', shown in FIG. 4, is formed by combining the carton blank 12 with the lid/handle blank 13, as shown in FIGS. 1–3. Referring to FIG. 1, the carton blank 12, includes two side panels 15 and 17. The side panel 15 is joined along a score line 16 to a top panel 23A. The side panel 17 is joined along a score line 18 to a top panel 23B. The side panel 17 is joined along score line 20 to a bottom panel 19, as shown in FIG. 1. An elongate glue flap 21 is joined to the side panel 15 along a score line 22 which is used in joining the side panel 15 to the bottom panel 19.

A group of flaps form end closures 25A and 25B foldably connected to the side panels 15 and 17 and the bottom panel 19. An outer end flap 26 is connected to the side panel 15 along a score line 27. An outer end flap 34 is foldably connected along score line 35 to the side panel 15 opposite the outer end flap 26. An inner end flap 28 is connected to the top panels 23A and 23B along a combination cut line/perforated line 29. An inner end flap 36 is connected to the top panels 23A and 23B along a combination cut line/perforated line 37 opposite the inner end flap 28.

In a preferred embodiment, the combination cut line/perforated lines 29 and 37 are comprised of alternating sections of cut line followed by ⅛ inch by ⅛ inch Perf Through lines which are well known to those skilled in the art. It should be understood that the lines 29 an 37 connect the inner cover flaps 28 and 36 to the top panels 23A and 23B during manufacture, loading, and shipment, but allow the inner cover flaps 28 and 36 to be efficiently separated from the top panels 23A and 23B by the user. A second pair of outer end flaps 30 and 38 are connected to the side panel 17 along score lines 31 and 39, respectively, as shown in FIG. 1.

A second pair of inner end flaps 32 and 40 are connected to the bottom panel 19 along score lines 33 and 41, respectively. It should be understood to those skilled in the art that score lines 16, 18, 20, 22, 27, 31, 33, 35, 38, and 41 allow the foldable material to fold about those score lines, but are not intended to weaken the material to allow the material to be torn or separated about those lines. In a preferred embodiment score lines 16 and 20 are eight (8) point wide rule lines which are well known to those skilled in the art.

Referring still to FIG. 1, the top panels 23A and 23B are joined medially along a cut line 24. If desired the cut line 24 may be notched (not shown) to provide a small portion of material which is not cut in order to hold the panels 23A and 23B together until the user opens the container 10. A handle opening 45 is defined in the top panel 23B. The handle opening 45 is defined by a handle flap 47 which is joined to the top panel 23A by a score line 48 and cut lines 54. The handle flap 47 is joined to the top panel 23B by a perforated line 55 which is preferably a 17 teeth per inch tear rule line.

A handle opening panel 49 is joined to the handle flap 47 and the top panel 23B along a combination cut line/perforated line 50 (preferably the perforated portion of line 50 is ¼ inch by ¼ inch Perf Through line) and cut line 51. A handle starter tab 53 is defined centrally of the handle opening 45 and is joined to the handle opening panel 49 along slit score 52. Slit scores are well known to those skilled in the art as scores which will readily fold about the score in one direction, but which will resist folding about the score in the opposite direction. If desired the cut line 51 may be notched, as described above, to hold the tab 53 in position until the user opens the carton 10.

Referring now to FIG. 2, the lid/handle blank 13 forms part of the blank 10' and forms part of the recloseable lid 11 of the present invention. The lid/handle blank 13 includes a top panel 60 and a bottom panel 62. The top panel 60 is joined to a side panel 64 along a perforated line 61 (preferably ¼ inch by ¼ inch Perf Through line). The bottom panel 62 is joined to the side panel 64 along a perforated line 63 (preferably ¼ inch by ¼ inch Perf Through line). A glue flap 65 is joined along a slit score line 66 to the bottom panel 62. As shown in FIG. 2, a pair of side flaps 67 and 69 are joined to opposing sides of the top panel 60 along score lines 68 and 70, respectively. A handle opening 71 is defined in the top panel 60 along a cut line 72. A panel lift opening 73 is defined in the top panel 60 along a cut line 74.

Initial Assembly

Referring now to FIGS. 3 and 4, the carton blank 12 and the lid/handle blank 13 are joined to form the blank 10' . As shown in FIG. 3, the lid/handle blank 13 is glued flat against the interior surface of the carton blank 12 by gluing the top panel 60 of the lid/handle blank 13 to the top panel 23B of the carton blank 12, applying glue to glue areas 79. Those skilled in the art will understand that automatic gluing and folding machinery using known techniques may be constructed to carry out this assembly in a mass production setting, but is not required to make a carton 10 embodying the present invention. Gluing the single-piece blank 13 to the carton blank 12, as described, forms the blank 10' shown in FIG. 4.

The single-piece blank 13 overlays the carton blank 12 with the top panel 60 of the lid/handle blank 13 overlaying the top panels 23A and 23B of the carton blank 12. In this configuration, the handle opening 71 underlies the handle opening 45 of the top panel 23B of the carton blank 12. The combination of the handle opening 71 of blank 13 and the handle opening 45 of blank 12 forms a handle 43, shown in FIG. 6.

The blank 10' is assembled into an intermediate, broken down, flat carton 10", shown in FIG. 5. The first step in this process is to fold the blank 10' inward 180° along score lines 16 and 61 until the glue flap 65 overlays a glue patch 80, shown in FIG. 4, adhering the glue flap 65 to the side panel 17.

Next, the bottom panel 19 is folded inward 180° until the glue patch 75 overlays the glue flap 21 (side not shown in FIG. 4). This results in the outer surface of the glue flap 21 adhering to the inner surface of the bottom panel 19, leaving the score line 22 aligned with the peripheral edge of the bottom panel 19, as shown in FIG. 5. The resulting flat assembly 10" is shown in FIG. 5. The carton 10" occupies very little space and therefore may be shipped efficiently to a factory or other location at which the carton may be erected and loaded.

Erecting the Carton

The carton 10" of FIG. 5 may be erected by exerting inward pressure on the score lines 18 and 22, causing the side panels to move apart and begin to form a sleeve having a rectangular or square cross section. Referring to FIGS. 4 and 6, after the carton 10" is opened into a sleeve configuration, as described, the inner end flaps 28 and 32 are folded inward about fold lines 29, 68, and 33, respectively. The outer end flaps 26 and 30 are then folded inward with the peripheral edge of end flap 30 overlying the outer surface of outer end flap 26, or vice versa (if desired). The inner end flaps 28 and 32 are glued to the interior surface of the outer end flaps 26 and 30 using glue patches 76, as shown in FIG. 4. The outer end flap 30 is adhered to the outer surface of the outer end flap 26 using glue patch 77. Thus, one end of the carton 10 is closed, as shown in FIG. 6.

The inner end flaps 28 and 32 are shown in phantom in FIG. 6 as they are adhered to the inner surface of outer end flaps 26 and 30. As should be apparent, the opposite end of the carton 10 is closed in a similar fashion by folding inner upper flaps 36 and 40 inward and subsequently folding outer end flaps 34 and 38 inward to overlay the inner end flaps 36 and 40. The inner end flaps 36 and 40 are adhered to the inner surfaces of the outer end flaps 34 and 38 by glue patches 76, as shown in FIG. 1. The peripheral edge of the outer end flap 38 is adhered to the exterior surface of the outer end flap 34 by glue patch 77 shown in FIG. 1. In a preferred embodiment, glue patches 75 and 80 are applied during manufacturing of the carton 10'. The remaining glue patches described herein may be applied when the carton 10 is erected during loading, as described below.

Loading and Opening the Carton

It should be understood to those skilled in the art, that the carton 10 is loaded by the manufacturer or distributor of the material to be contained in the carton. Preferably, the manufacturer or distributor will close one end of the carton 10, as described above, and then set the carton 10 on the closed end during filling. It should be understood that during the filling process the recloseable lid 11 is secure and will remain closed until subsequently opened by a user. After the carton 10 is filled with product the product manufacturer or distributor will then close the unclosed end, as described above. After the carton 10 is closed, as described, the carton 10 may be rotated 90° so that the carton 10 rests on panel 19 for shipment and storage.

Figure 9:
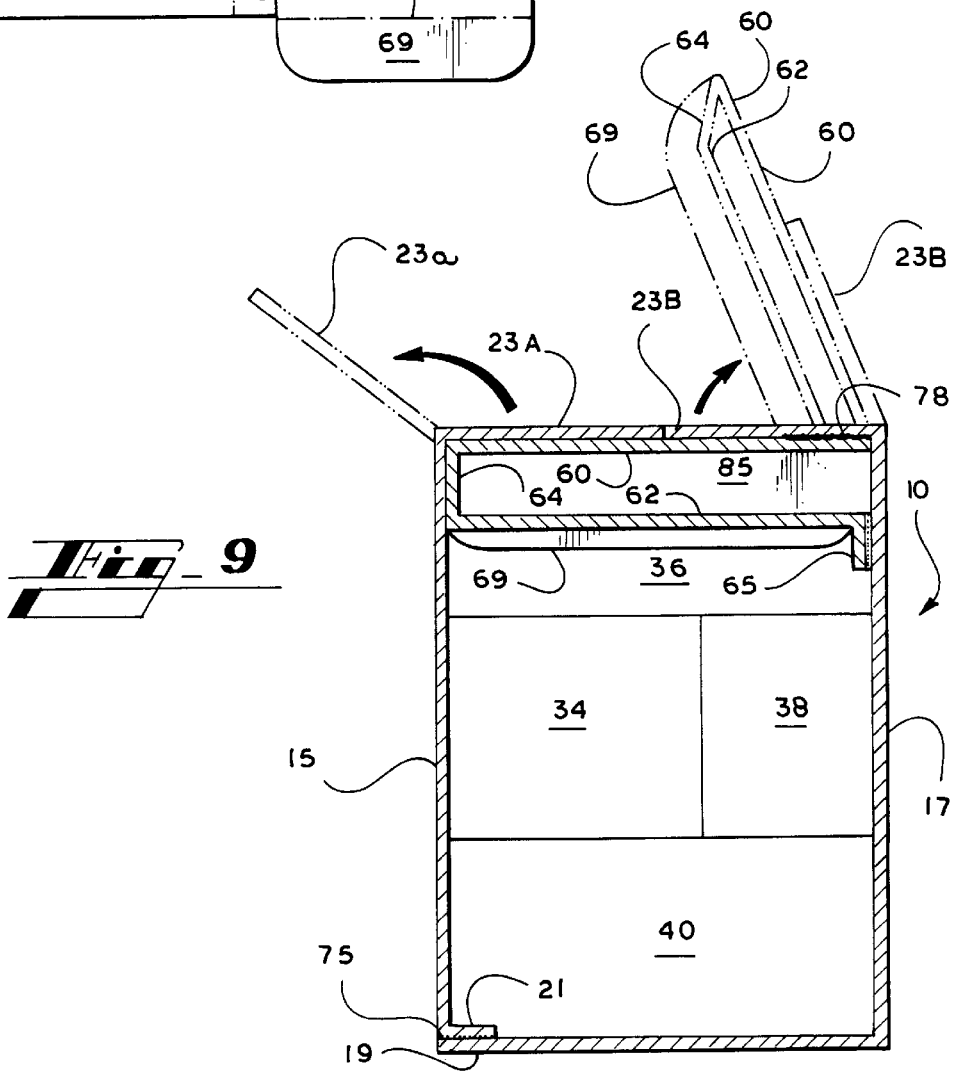
FIG. 9 is a side elevation cross-sectional view of the carton of FIG. 6 taken along line 9—9.
Figure 7:
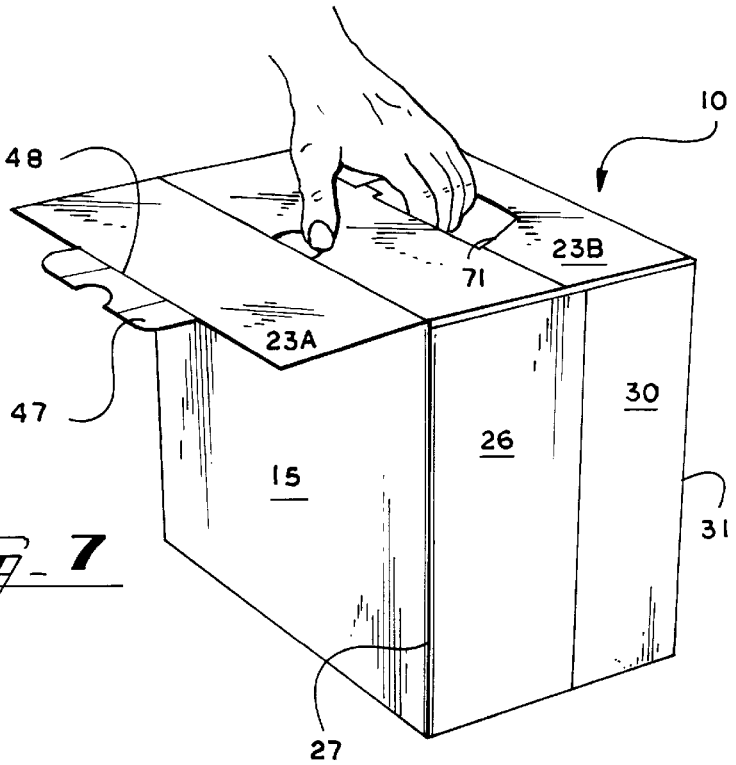
FIG. 7 is a pictorial view of the carton of FIG. 6 showing the top closure flap in an open configuration.

The lid/handle blank 13, shown in FIG. 2, in concert with the top panels 23A and 23B of the carton blank 12, shown in FIG. 1, forms a recloseable lid 11 for the carton 10. When the carton 10 is erected, as described above, the panel 60 and panel 62 are moved into a parallel spaced-apart configuration, as shown in FIGS. 6 and 9. The panel 62 divides the carton 10 into two compartments 85 and 86, as shown in FIG. 6. FIG. 7 illustrates the carton 10 with the top panel 23A in an open configuration. The compartment 86 may be used to hold product, and the compartment 85 serves as a space for the fingers and hand of the user when the user carries the carton 10 or opens the carton 10, as shown in FIG. 7.

The interior top panel 60 is adhered to the inner surface of the carton top panel 23B. In the fully erected and closed configuration, shown at FIG. 6, the upper surface of the top panels 23A and 23B of the carton 10 are smooth and flush. This configuration allows for efficient shipping of the erected, filled and sealed carton 10. As illustrated in FIG. 6, the recloseable lid side flaps 67 and 69 are folded downward and are inserted into the carton 10 inside the inner end flaps 28 and 36.

In order to carry the carton 10, the user deploys the handle 43 by inserting his or her fingers through the handle opening 45 located on the top panel 23B of the carton 10. To insert the user's fingers, the handle opening panel 49 is first folded downward along the line 50 and inside the handle opening 45 between the spaced-apart panels 60 and 62. In the preferred embodiment, a starter tab 53 is provided which allows the user to quickly and efficiently separate the handle flap 47 from the handle opening panel 49. Also, in the preferred embodiment, the starter tab 53 folds between panels 60 and 62 and holds the handle opening panel 49 in the folded configuration. The handle flap 47 is then folded down and inside handle opening 43 of the carton 10 between the spaced-apart panels 60 and 62. Accordingly, the user's fingers will now fit through the handle opening 45 and interior of the panels 60 and 62 for carrying the carton 10.

Referring to FIGS. 3 and 4, when the handle flap 47 is folded inside the carton 10, as described, the panels 47*a* at opposite ends of the handle flap 47 engage the curved portion of the handle opening 71 which keeps the handle flap 47 in a closed and locked position. It should be understood that this configuration is utilized after the user has initially opened the carton 10, as described below, and desires to reclose the recloseable lid 11 and/or carry the carton 10.

Figure 8:
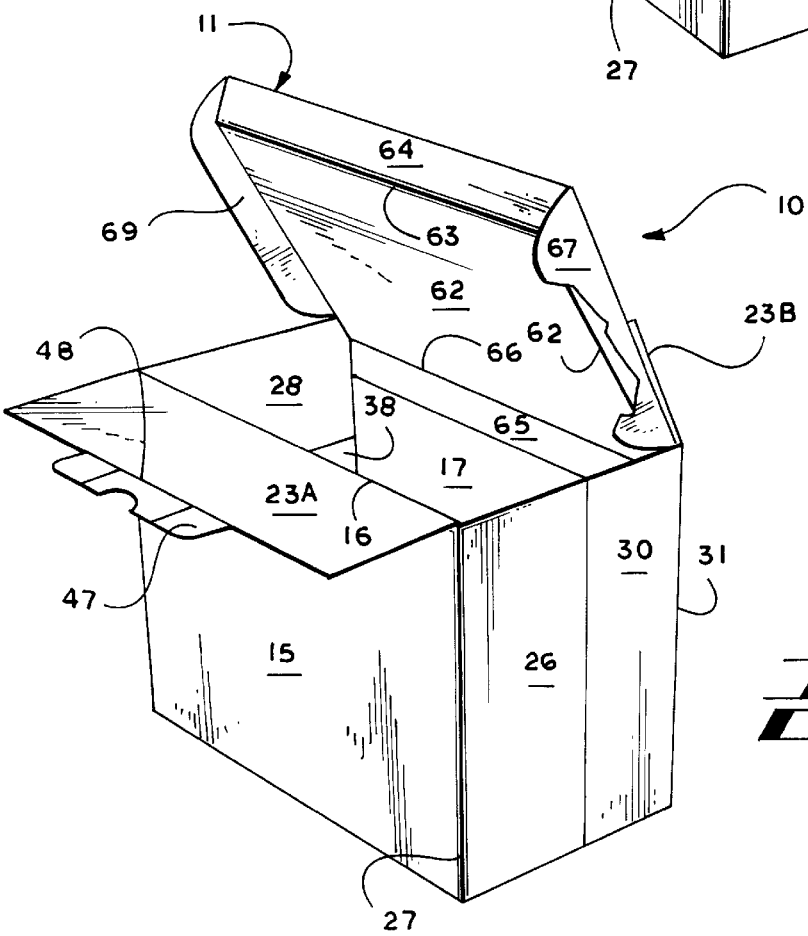
FIG. 8 is a pictorial view of the carton of FIG. 6 showing the top closure flap and recloseable lid in an open configuration and showing a portion of the top closure panels side flap broken away to show interior detail.

FIGS. 7 and 8 illustrate the steps involved in opening the carton 10 of the preferred embodiment of the present invention. To open the carton 10, the user, after having deployed the handle 43, as described above, pulls the top panel 23A away from the top panel 23B and rotates the top panel 23A about the score line 16, as shown in FIG. 7. The user then inserts his or her fingers through the handle opening 71 and inserts his or her thumb through the panel lift opening 73 in the panel 60, as shown in FIG. 7, and pulls the recloseable lid 11 to rotate the recloseable lid about the score line 18 and up from the top of the carton 10, as shown in FIGS. 8 and 9. After the carton 10 has been initially opened and reclosed, as described above, the user may reopen the carton 10 by inserting his or her finger into the starter tab 53 to disengage the panels 47*a* to allow the handle flap 47 to be withdrawn from the interior of the handle opening 43.

As shown in FIG. 9, as the recloseable lid 11 is opened away from the top of the carton 10, the rectangular shaped recloseable lid 11 formed from the parallel spaced-apart panels 60 and 62 assumes a parallelogram cross-section as the recloseable lid 11 rotates up and away from the top of the carton 10. That is, the lid side panel 64 is substantially perpendicular to the bottom panel 62 when the recloseable lid 11 is in a closed configuration. As the recloseable lid 11 is opened the angle between the side panel 64 and the bottom panel 62 becomes obtuse, as shown in FIG. 9 (shown in phantom).

In the preferred embodiment, the recloseable side flaps 67 and 69 remain tucked (not shown) inside the carton 10 during opening, use, and closing of the carton 10, allowing the recloseable lid 11 to be closed by simply urging the recloseable lid 11 into a closed position, as shown in FIG. 7. Alternatively, the recloseable lid side flaps 67 and 69 may flip slightly outward to engage the upper peripheral edges of the side panels 30 and 38, in edge-to-edge fashion, as shown in FIG. 8. Accordingly, the recloseable lid 11 is propped in an upright position to facilitate removal of the contents of the carton 10.

After the user has removed a desired quantity of product from the carton 10, the user may close the recloseable lid by reversing the above described steps. In the alternative opening description, described above, the user urges the recloseable lid side flaps 67 and 69 inward so that they will slide interior of the side walls 30 and 38 of the carton 10. Next, the user urges the recloseable lid 11 downward to a starting position, as shown in FIGS. 7 and 9.

In the preferred embodiment the width of the panels 60 and 62 of the recloseable lid 11 are made with a sufficient width to give the recloseable lid 11 a tight friction fit when closed. The user then rotates the top panel 23A inward on top of the top panel 60, as shown in FIGS. 6 and 9. If desired, the user may then fold the handle flap 47 into the handle opening 45 and underneath the panel 60. This action locks the top panel 23A to the recloseable lid top panel 60. Accordingly, the user may then carry the carton 10 by inserting his or her fingers into the handle 43 without opening the recloseable lid 11 during carrying. Also, locking the top panel 23A over the lid top panel 60 as described prevents spillage of the contents of the carton 10.

Alternate Embodiment

Figure 10:
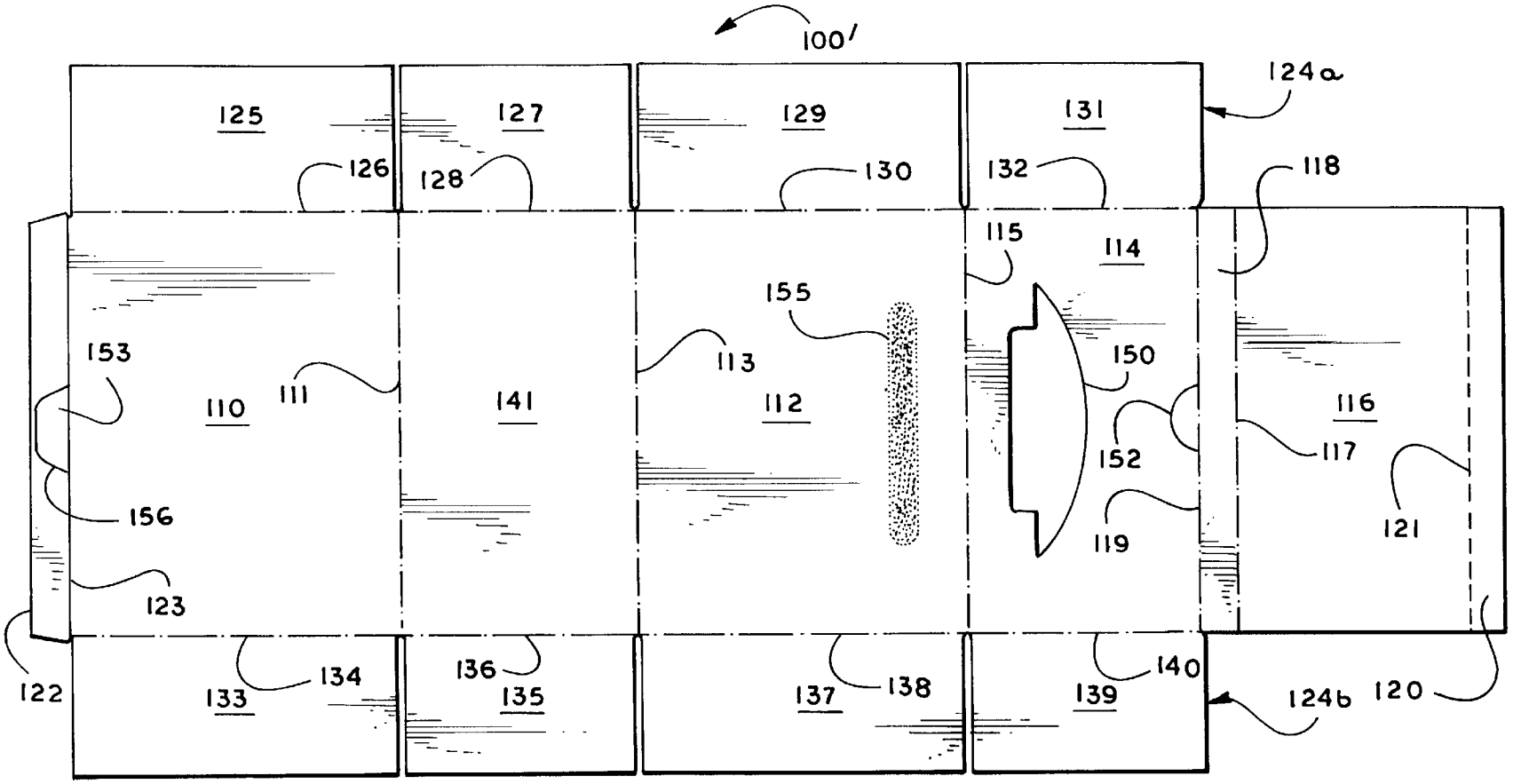
FIG. 10 is a plan view of the interior surface of a blank from which an alternate embodiment of a carton according to the present invention can be assembled.

A carton 100 providing an alternate embodiment of the present invention may be constructed from a blank 100', as shown in FIG. 10. The blank 100' has many elements in common with the blank 10', but differs in the construction of its recloseable lid 105. Additionally, the carton 100 is formed from a blank 100', as opposed to the blank 10' of the preferred embodiment.

The blank 100' includes side panels 110 and 112 which are foldably connected to a bottom panel 141 along score lines 111 and 113, respectively. A glue flap 122 is foldably connected to the side panel 110 along a perforated line 123. As should be understood, line 123 may be a perforated line or may include a tear strip (not shown) to facilitate opening the carton 100. End closures 124*a* and 124*b* are provided for closing the ends of the carton 100. The end closure 124*a* includes outer end flaps 125 and 129 foldably connected along score lines 126 and 130 to side panels 110 and 112. An inner end flap 127 is connected to the bottom panel 141 about a score line 128, and the inner end flap 131 is connected along a combination cut line/perforated line 132 to an upper lid panel 114. The end closure 124*b* includes outer end flaps 133 and 137 connected to side panels 110 and 112 along score lines 134 and 138. An inner end flap 135 is connected to the bottom panel 141 along score line 136, and inner end flap 139 is connected along combination cut line/perforated line 140 to the upper lid panel 114.

The upper lid panel 114 is foldably connected to the side panel 112 along a score line 115. The upper lid panel 114 is connected to a lid side panel 118 along a perforated line 119 (preferably ¼ inch by ¼ inch Perf Through line). A lower lid panel 116 is connected to the lid side panel 118 along a perforated line 117 (preferably ¼ inch by ¼ inch Perf Through line). The lower lid panel 116 is connected to a glue flap 120 along a score line 121. A handle 151 is formed along a cut line 151, and a finger pull opening 153 is formed along a cut line 156.

Score lines 111, 113, 115, 121, 126, 128, 130, 134, 136, and 138 are preferably 8 point wide rule score lines. Perforated lines 123, 132 and 140 are preferably ⅛ inch by ⅛ inch Perf Through lines.

The carton 100 is formed by first folding the recloseable lid bottom panel 116 inward along a fold line 119 until the glue flap 120 overlays a glue patch 155 shown in FIG. 10. The blank 100' may then be folded into an intermediate flat carton for shipment and storage as was similarly described for the carton 10" of the preferred embodiment. In order to fold the blank 100' into the intermediate carton (not shown), the blank 100' is folded inward about score line 113 until the outer end flaps 125 and 133 overlay the inner end laps 131 and 139 respectively.

Figure 11:
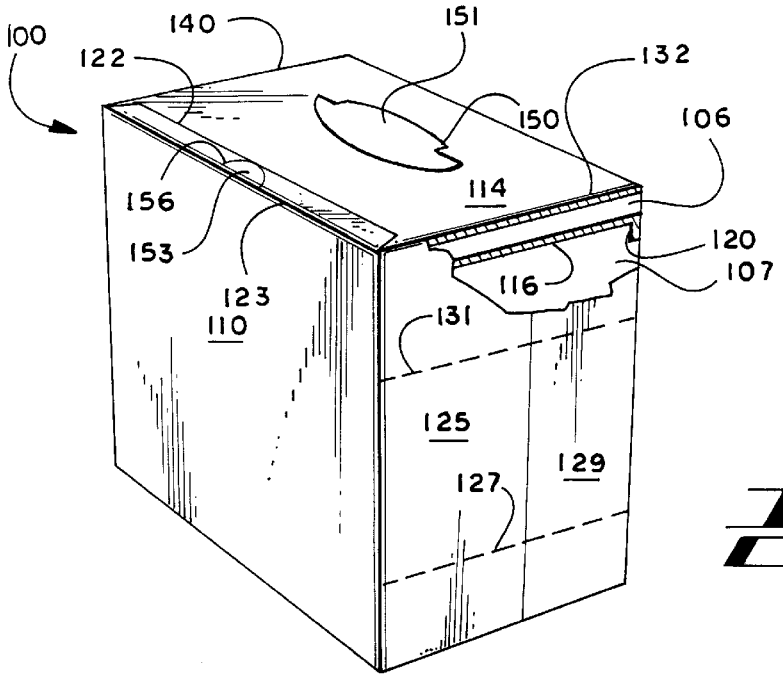
FIG. 11 is a pictorial view of a fully erected and closed carton formed from the blank of FIG. 10 with portions of the side walls broken away to show interior detail.

The intermediate form is glued by gluing the glue flap 122 to the outer side of the recloseable lid top panel 114 as shown in FIGS. 10 & 11. As with the preferred embodiment, as described above, the carton in this configuration may be easily shipped to manufacturers and distributors of product to be contained in the carton 100.

The carton 100, shown in FIG. 11, is formed by exerting inward pressure on the score lines 123 and 113 causing the side panels to move apart and begin to form a sleeve having a rectangular or square cross section. One end of the carton 100 may then be closed by folding the inner end flap 135 and 139 inward about score line 136 and cut line 140, respectively. The outer end flaps 133 and 137 may then be folded inward over the inner end flaps 135 and 139 about fold lines 134 and 138, respectively. The inner end flaps 135 and 139 and outer end flaps 133 and 137 may be adhered to each other by a gluing process, as described for the preferred embodiment above.

Before the opposite end of the carton 100 is closed, the manufacturer of the product to be contained by the carton 100 may then fill the carton 100 with a desired quantity of product. The unclosed end of the carton 100 may then be closed by folding the inner end flaps 127 and 131 inward about score line 128 and cut line 132, respectively. The outer end flaps 125 and 129 may then be folded over the inner end flaps 127 and 131 about the score lines 126 and 130 respectively. The inner end flaps 127 and 131 and the outer end flaps 125 and 129 may then be glued in place.

The fully erected and sealed carton 100 is shown in FIG. 11. Inner end flaps 127 and 131 are shown in phantom. As can be seen from the broken away portion of the outer end flaps 125 and 129 and the inner end flap 131, a recloseable lid 105 is formed by the erection of the carton 100 and includes a recloseable lid top panel 114 and a recloseable lid bottom panel 116. As with the carton 10 described above, the recloseable lid bottom panel 116 partitions the carton 100 into two compartments 106 and 107. As with the carton 10 of the preferred embodiment, the compartment 107 may be used to hold the product contained by the carton 100 and the compartment 106 serves as a space for the fingers of the hand of the user when carrying the carton 100 via the handle 151 located in the recloseable lid top panel 114, as shown in FIG. 11.

Figure 12:
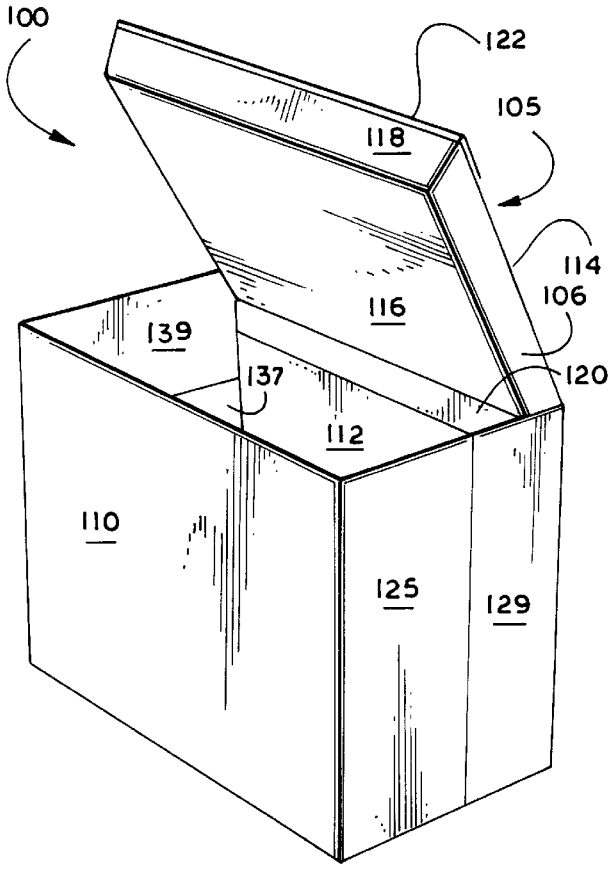
FIG. 12 is a pictorial view of the carton of FIG. 11 showing the recloseable lid in an open configuration.
Figure 13:
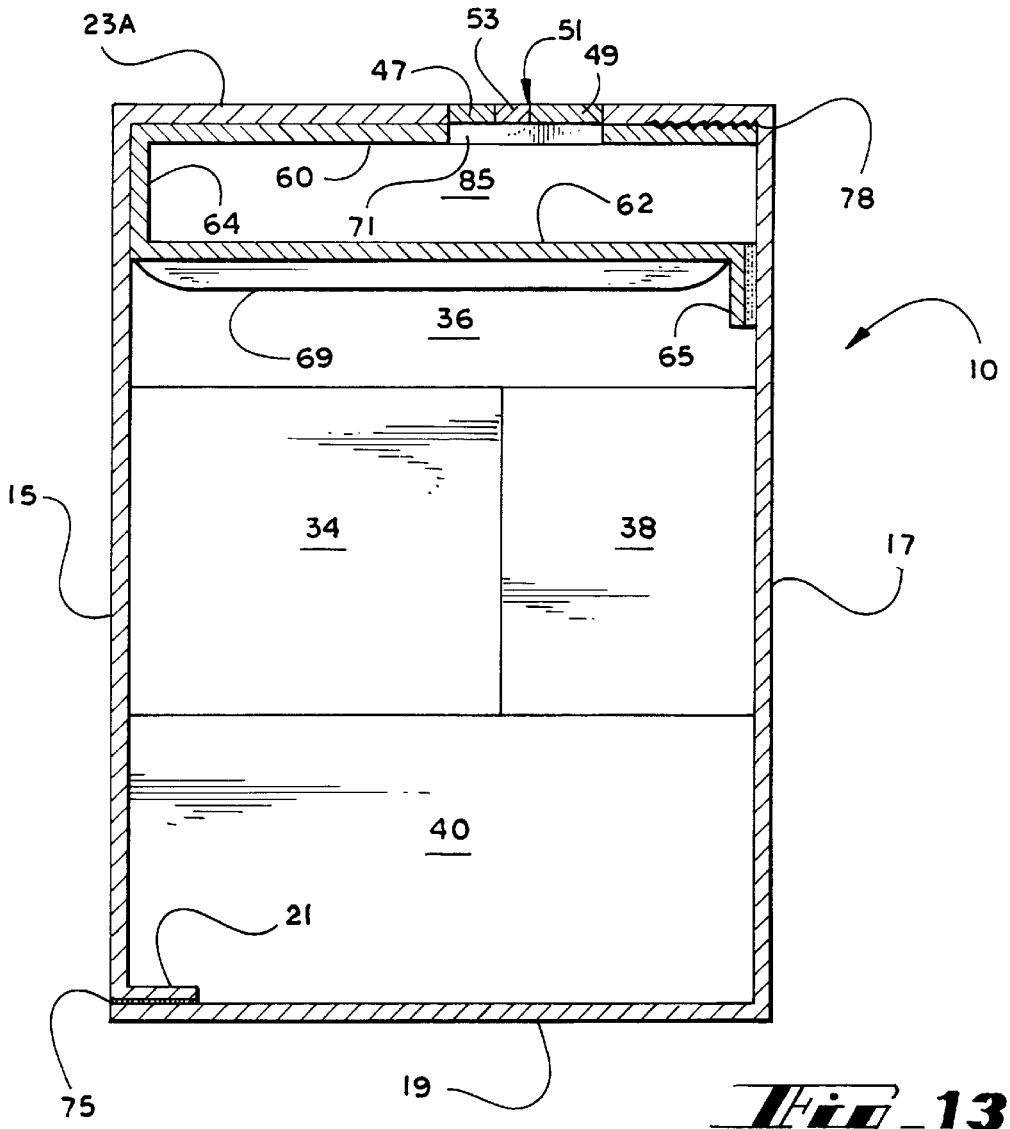
FIG. 13 is a side elevational cross-sectional view of the carton of FIG. 6, taken along line 13—13.
Figure 14:
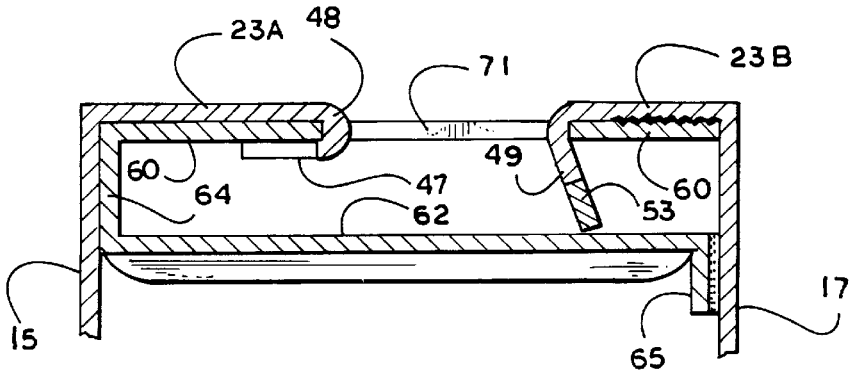
FIG. 14 is a partial side cross-sectional view of the carton of FIG. 13, showing the handle and handle opening panels in their folded configurations.

In order to open the recloseable lid 105 of the carton 100, the user pulls upward on the finger pull opening 153, shown in FIG. 11, until the perforated score lines 123, 132 and 140 tear away to allow the recloseable lid 105 to lift up and away from the top of the carton 100, as shown in FIG. 12. The recloseable lid 105 of the carton 100 may be closed by exerting pressure on the upper side of the recloseable lid 105 to urge the recloseable lid back to a closed position as shown in FIG. 11. As with carton 10 of the preferred embodiment, the width of the panels 114 and 116 of the recloseable lid 105 are made with a sufficient width to give the recloseable lid 105 a tight friction fit when closed.

While the present invention has been described with particular reference to the preferred and alternate embodiments thereof, it should be understood that variations and modifications can be made without departing from the spirit and scope of the invention as defined in the appended claims.

What is claimed is:

1. A carton, comprising:

a plurality of carton side panels;

a bottom panel;

a lid hingedly connected to one of said plurality of carton side panels at a location spaced below the upper edge thereof and along one side of said lid, said lid comprising:

an upper panel including a handle opening therein, said upper panel having an outer surface;

a lower panel adhered along said one side of said lid to said one carton side panel in spaced-apart relation to said upper panel; and a lid side panel extending between said upper and lower panels spaced away from said one carton side panel to which said lid is hingedly connected, to hold said upper and lower panels in spaced-apart relation to one another;

such that said lower panel forms a partition interior of said carton and said lid assumes the shape of a parallelogram as said lid moves out of said carton about its hinged connection; and a carton top panel adhered to the outer surface of said upper panel of said lid.

2. The carton of claim 1, wherein said lid side panel is substantially perpendicular to said lower panel when said lid is in a closed configuration; and said lid side panel is at an obtuse angle relative to said lower panel when said lid is in an open configuration.

3. The carton of claim 1, wherein said partition is substantially parallel to said top surface when said lid is closed.

4. The carton of claim 1, wherein said partition divides said carton into two compartments.

5. The carton of claim 1, wherein said upper panel has first and second ends, and wherein said lid comprises:

a pair of flaps foldably attached to said upper panel with one of said pair of flaps attached at each of said first and second ends of said upper panel; and wherein when said lid is closed, said flaps are folded downwardly substantially perpendicular to said upper panel and into said carton.

6. The carton of claim 5, wherein each of said flaps of said pair of flaps is capable of engaging upper edges of one of said plurality of side panels to hold said lid in an open configuration.

7. The carton of claim 1, further comprising another carton top carton panel hingedly connected to another one of said carton side panels and defining a handle panel foldable into said handle opening formed in said upper panel of said lid for carrying said carton.

8. The carton of claim 7, wherein said handle panel folds into said handle opening and away from said hinged connections of said lid to lock said lid while said carton is being carried.

9. The carton of claim 1, further comprising:

a second carton top panel hingedly connected to an upper edge of one of said plurality of side panels opposite said one of said plurality of side panels to which said lid is connected; and wherein said second carton top panel overlays a portion of said upper panel of said lid when said lid is in a closed configuration.

10. The carton of claim 9, wherein said second carton top panel comprises a handle flap hingedly connected to a peripheral edge of said second carton top panel, wherein when said handle flap is folded downward, said handle flap folds into said handle opening and between said upper and lower panels of said lid to lock said lid in a closed configuration.

11. The carton of claim 10, wherein respective peripheral edges of said carton top panels lie adjacent to one another when said second carton top panel overlays a portion of said upper panel of said lid.

12. The carton of claim 1, wherein said plurality of side panels and said bottom panel are formed from a first blank of material; and said lid is formed from a second blank of material.

13. The carton of claim 1, wherein said carton is formed from corrugated paperboard.

14. A reclosable carton, comprising:

a plurality of carton sides;

a bottom carton panel;

a top carton panel hingedly connected to a first one of said carton sides; and a lid hingedly connected along one side of said lid to an upper region of a second one of said plurality of carton sides, said lid comprising:

an upper lid panel approximately parallel to said top carton panel and including a handle opening therein;

a lower lid panel positioned in spaced-apart relation to said upper lid panel; and a lid side panel extending between said upper and lower lid panels spaced away from said second carton side to which said lid is connected, to hold said upper and lower lid panels in spaced-apart relation to one another;

said lower lid panel forming a partition interior of said carton substantially blocking a top opening of said carton;

said top carton panel defining a peripheral edge extending sufficiently near said handle opening to be grasped with said upper lid panel when said top carton panel is in a carrying position adjacent to said upper lid panel, and being foldable from said carrying position to a dispensing position in which said lid can be opened, whereby said top carton panel can be repositioned into said carrying position after said lid has been opened and reclosed.

15. The carton of claim 14, further comprising a handle panel extending from a portion of said peripheral edge of said top carton panel, said handle panel being foldable into said handle opening in said upper lid panel, to a position between said upper and lower lid panels.

16. The carton of claim 15, wherein said handle panel folds into said handle opening, and away from said hinged connection of said lid to lock said lid while said carton is being carried.

17. The carton of claim 16, further comprising:

a second top carton panel hingedly connected to an upper edge of said second carton side panel to which said lid is connected;

said second top carton panel overlaying a portion of said upper lid panel and being fixedly attached thereto.

18. The carton of claim 17, wherein said second top carton panel defines a handle opening panel positioned opposite said handle panel and foldable into said handle opening to a position between said upper and lower lid panels in a direction opposite to the folding of said handle panel.

19. The carton of claim 18, wherein further comprising a tab extending outwardly from said handle opening panel, said tab being capable of retaining said handle opening panel in a position folded away from said handle panel.

20. The carton of claim 14, wherein said handle panel defines a pair of locking panels at opposite ends thereof, said locking panels catching under said handle opening in said upper lid panel when said handle panel is folded, to lock said first top carton panel against said lid.

21. A reclosable carton, comprising:

a plurality of carton sides;

a bottom carton panel;

a top carton panel hingedly connected to a first one of said carton sides and releasably connected to one or more of the remaining carton sides; and a lid hingedly connected along one side of said lid to an upper region of a second one of said plurality of carton sides, said lid comprising:

an upper lid panel including a handle opening therein;

a lower lid panel positioned in spaced-apart relation to said upper lid panel; and a lid side panel extending between said upper and lower lid panels spaced away from said second carton side to which said lid is connected, to hold said upper and lower lid panels in spaced-apart relation to one another;

said lower lid panel forming a partition interior of said carton substantially blocking a top opening of said carton;

said top carton panel being foldable, after being released from said remaining carton sides, to a position in which said lid can be opened.

22. The carton of claim 21, further comprising a handle panel extending from said top carton panel, said handle panel being foldable into said handle opening in said upper lid panel, to a position between said upper and lower lid panels.

23. The carton of claim 22, further comprising:

a second top carton panel hingedly connected to an upper edge of said second carton side panel to which said lid is connected;

said second top carton panel overlaying a portion of said upper lid panel and being fixedly attached thereto.

* * * * *